US006619952B2

(12) United States Patent
Hohenshelt et al.

(10) Patent No.: US 6,619,952 B2
(45) Date of Patent: Sep. 16, 2003

(54) KILN WITH DROP-DOWN CONTROL PANEL

(75) Inventors: John S. Hohenshelt, Heath, TX (US); Robert L. Gieselman, Dallas, TX (US); David T. Beaumont, Dallas, TX (US)

(73) Assignee: JSH Management, Inc., Heath, TX (US)

( * ) Notice: Subject to any disclaimer, the term of this patent is extended or adjusted under 35 U.S.C. 154(b) by 0 days.

(21) Appl. No.: 10/307,836

(22) Filed: Dec. 2, 2002

(65) Prior Publication Data

US 2003/0080105 A1 May 1, 2003

(51) Int. Cl.[7] ..... F27D 23/00

(52) U.S. Cl. ..... 432/76; 432/3; 432/120; 432/247

(58) Field of Search ..... 432/3, 76, 120, 432/121, 247

(56) References Cited

U.S. PATENT DOCUMENTS

| | | | |
|---|---|---|---|
| 3,196,252 | A | 7/1965 | Weingrad |
| 3,752,643 | A | 8/1973 | Robinson |
| 3,786,162 | A | 1/1974 | Colson |
| 3,958,923 | A | 5/1976 | Duncan |
| 4,139,340 | A | 2/1979 | Bartel |
| 4,215,265 | A | 7/1980 | White |
| 4,272,670 | A | 6/1981 | Docx |
| 4,536,153 | A | 8/1985 | Anthony |
| 4,628,895 | A | 12/1986 | Santilli |
| 4,692,593 | A | 9/1987 | Chiu |
| 4,705,930 | A | 11/1987 | Sathre, Jr. et al. |
| 5,378,144 | A | 1/1995 | Cress |
| 5,477,029 | A | 12/1995 | Skutt et al. |
| 5,498,852 | A | 3/1996 | Cress |
| 5,734,149 | A | 3/1998 | Skutt et al. |
| 5,910,006 | A | 6/1999 | Conroy et al. |

*Primary Examiner*—Jiping Lu
(74) *Attorney, Agent, or Firm*—Dennis T. Griggs

(57) ABSTRACT

A kiln has a control box pivotably coupled to an oven portion via a hinge at a lower end of the control box so that the control box can pivot about the hinge from a closed position adjacent the oven portion to an open position where an upper end of the control box is separated from the oven portion. The control box houses electronic controller components. A chimney portion is attached to the oven portion and is separated from the upper end of the control box when the control box is in the open position. The control box pivots about the hinge along a generally horizontal axis. A linkage is coupled between the control box and the oven portion to limit the pivotal movement range of the control box at the open position.

20 Claims, 7 Drawing Sheets

KILN WITH DROP-DOWN CONTROL PANEL

TECHNICAL FIELD

The present invention relates to kilns. In one aspect, it relates to kilns having electronics in a control box used for controlling kiln temperature and heat cycles.

BACKGROUND OF THE INVENTION

Kilns are often used for firing pottery or ceramics, both commercially and among hobbyists. Kilns are also often used in laboratories to provide specific heat cycles for forming materials and/or testing already-formed materials. Kilns are also used by custom knife artisans for creating and/or heat treating knife blades. There are many other possible uses for kilns, including but not limited to: annealing, china painting, enameling, glass fusing, glass sagging, glass shaping, heat treating, jewelry fabrication, porcelain, silver clay, and stoneware, for example. The sizes and shapes of currently available kilns vary widely. Usually, the sizes and shapes of kilns correspond to the intended use of the kiln.

Many kilns include an electronic controller for controlling parameters such as: temperature, heating time, and specific heat cycle, for example. Such electronic controllers typically include keys or buttons for inputs, a display, a circuit board, and power relays, for example. Such components of an electronic controller are often mounted in a control box. The control box is typically attached to the outside of the kiln and insulated from kiln heat to prevent damage to the components of the electronic controller.

Internal temperatures within the kiln may be as hot as 2300° F. during operation of the kiln. Usually, thick ceramic blocks forming walls define an oven space or enclosure, and are used to confine the heat within the kiln. However, the outside surface of the kiln may still experience temperatures as hot as 400° F. Because the components of the electronic controller are often merely inches away from the outer surface of the kiln, an insulating section is typically located between the electronic controller components and the outer skin of the kiln. Such insulating section may include a chimney structure that vents the heat from the kiln upward through the chimney and away from the electronic controller components. Such a chimney structure usually provides a path for setting up convection air currents flowing through and out of the chimney structure. Hence, the temperatures experienced by the electronic controller components will often be less than about 130° F. The upper limit of an operating temperature range for some of the electronic controller components is typically about 150° F.

Because the electronic controller components regularly experience temperatures near their operating temperature limits, as well as many changes in temperature as a kiln is used (i.e., many heat cycles), some of the electrical components have relatively short lives. The relays often fail most frequently and may need routine replacement if the kiln is regularly or heavily used. When a relay has failed, it is often desirable to locate the failed relay using a test probe. Conventional control boxes often must be removed or dismantled to access components of the electronic controller. This may require kiln operation down time and/or a skilled repair technician. To test the relays it is often desirable to perform a live test while the kiln is powered. However, most conventional kilns do not provide a convenient and/or safe means of performing such tests. Hence, there is a need for a way to quickly and easily access the components of an electronic controller for troubleshooting, repairing, and/or replacing such components.

U.S. Pat. No. 5,477,029 (Skutt, et al.) discloses a kiln having a control box mounted on the kiln by a hinge that pivots about a vertical axis. The control box includes a thermally insulated baffle therein, which insulates and covers the electronic components within the control box from the kiln heat. When released from being secured to the kiln, the control box is free to pivot on hinges about a vertical axis. However, most of the components of the electronic controller are not exposed and accessible when the control box is free to pivot on its hinges. To replace one of the components within the control box, such as a relay, the thermally insulated baffle will likely need to be removed and/or the control box dismantled to do so. Also, it will likely be more convenient to remove the control box from its hinges to replace a component in the control box. Also, the free swinging of the control box on its hinges about a vertical axis will likely make it difficult to safely probe testing points during troubleshooting. Hence, there is a need for an improved mounting configuration for the control box and the electronic controller components therein.

BRIEF SUMMARY OF THE INVENTION

The problems and needs outlined above are addressed by embodiments of the present invention. In accordance with one aspect of the present invention, a kiln is provided, which includes an oven portion, a control box, electronic controller components, and a thermally insulating chimney portion. The oven portion has walls defining an oven space. The control box is pivotably coupled to the oven portion via a hinge at a first end of the control box so that the control box may be pivoted about the hinge from a closed position adjacent the oven portion to an open position where a second end of the control box is separated from the oven portion by a first spaced distance. The electronic controller components are attached to and located at least partially within the control box. The thermally insulating chimney portion is attached to the oven portion. The chimney portion is located between the oven portion and the electronic controller components when the control box is in the closed position. The chimney portion is separated from the second end of the control box by a second spaced distance when the control box is in the open position.

The control box is configured to pivot about the hinge along a generally horizontal axis. The kiln may further include a linkage coupled between the control box and the oven portion so that the linkage limits a pivot movement range of the control box about the hinge at the open position. A keypad and a display of the electronic controller components may be located on the second end of the control box, wherein the first end is a lower end and the second end is an upper end of the control box.

Vertical sides of the control box are separated from vertical sides of the chimney portion when the control box is in the closed position so that air channels are defined between the vertical sides of the control box and the vertical sides of the chimney portion. The chimney portion may include a first sheet metal channel attached to the oven portion, a second sheet metal channel attached to the first sheet metal channel, and a layer of insulating material attached to the second sheet metal channel. Preferably, the electronic controller components are accessible when the control box is in the open position.

In accordance with another aspect of the present invention, a kiln is provided, which includes an oven portion, a control box, and electronic controller components. The oven portion has walls defining an oven space. The control box is pivotably coupled to the oven portion via a hinge at a first end of the control box so that the control box may be pivoted about the hinge along a generally horizontal axis from a closed position adjacent the oven portion to an open position where a second end of the control box is separated from the oven portion by a first spaced distance. The electronic controller components are attached to and located at least partially within the control box.

The kiln may include a thermally insulating chimney portion attached to the oven portion, wherein the chimney portion is located between the oven portion and the electronic controller components when the control box is in the closed position, and wherein the chimney portion is separated from the second end of the control box by a second spaced distance when the control box is in the open position. The kiln may include a linkage coupled between the control box and the oven portion, with the linkage being configured to limit a pivot movement range of the control box about the hinge at the open position. Preferably, the electronic controller components are accessible when the control box is in the open position.

In accordance with yet another aspect of the present invention, a kiln is provided, which includes an oven portion, a control box, a linkage, and electronic controller components. The oven portion has walls defining an oven space. The control box is pivotably coupled to the oven portion via a hinge at a first end so that the control box may be pivoted about the hinge from a closed position adjacent the oven portion to an open position where a second end of the control box is separated from the oven portion by a first spaced distance. The linkage is coupled between the control box and the oven portion, with the linkage being configured to limit a pivot movement range of the control box about the hinge at the open position. The electronic controller components are attached to and located at least partially within the control box.

DESCRIPTION OF THE DRAWING

The above features of the present invention will be more clearly understood from consideration of the following descriptions in connection with accompanying drawings in which.

DETAILED DESCRIPTION OF PREFERRED EMBODIMENT

Figure 1:
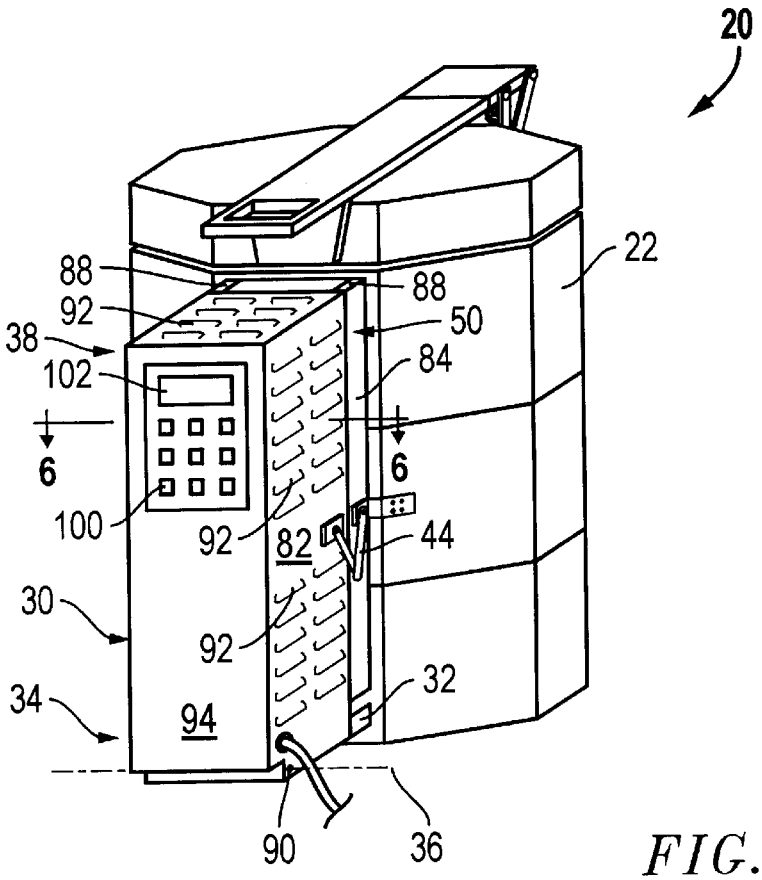
FIG. 1 is a front perspective view of a kiln disposed in an upright operative position in accordance with the preferred embodiment of the present invention.

Referring now to the drawings, wherein like reference numbers are used herein to designate like elements throughout the various views, preferred embodiments of the present invention are illustrated and described. As will be understood by one of ordinary skill in the art, the figures are not necessarily drawn tod scale, and in some instances the drawings have been exaggerated and/or simplified in places for illustrative purposes only. One of ordinary skill in the art will appreciate the many applications and variations of the present invention in light of the following description of preferred embodiments of the present invention. The preferred embodiments discussed herein are illustrative examples of the present invention and do not limit the scope of the invention to the preferred embodiments described.

The present invention relates to kilns having electronics in a control box for controlling kiln temperatures and/or heat cycles. This section will describe preferred embodiments of the present invention and advantages of the embodiments.

FIG. 1 is a front perspective view of a kiln 20 in accordance with a the preferred embodiment of the present invention. The kiln 20 has a generally cylindrical-shaped oven portion 22 with a generally polygonal cross-section shape. The oven portion 22 has walls made from ceramic blocks (not shown). The walls of the oven portion 22 define an oven space therein where objects may be heated.

Figure 2:
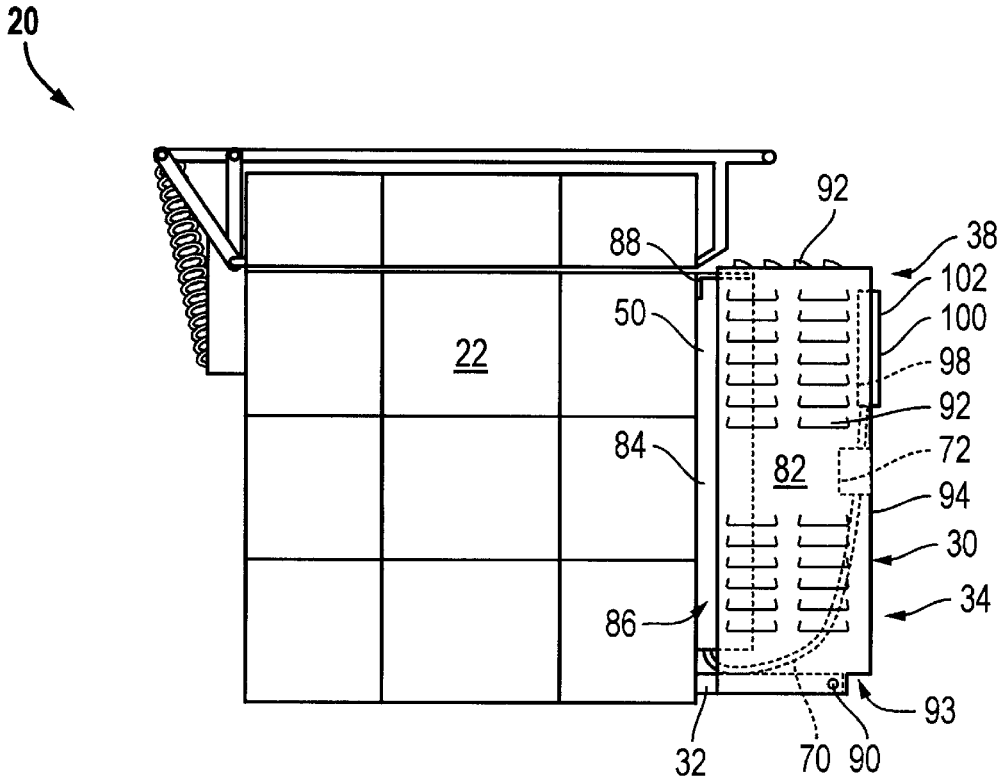
FIG. 2 is a side view of the kiln of FIG. 1 showing a drop-down control box in a closed position.
Figure 3:
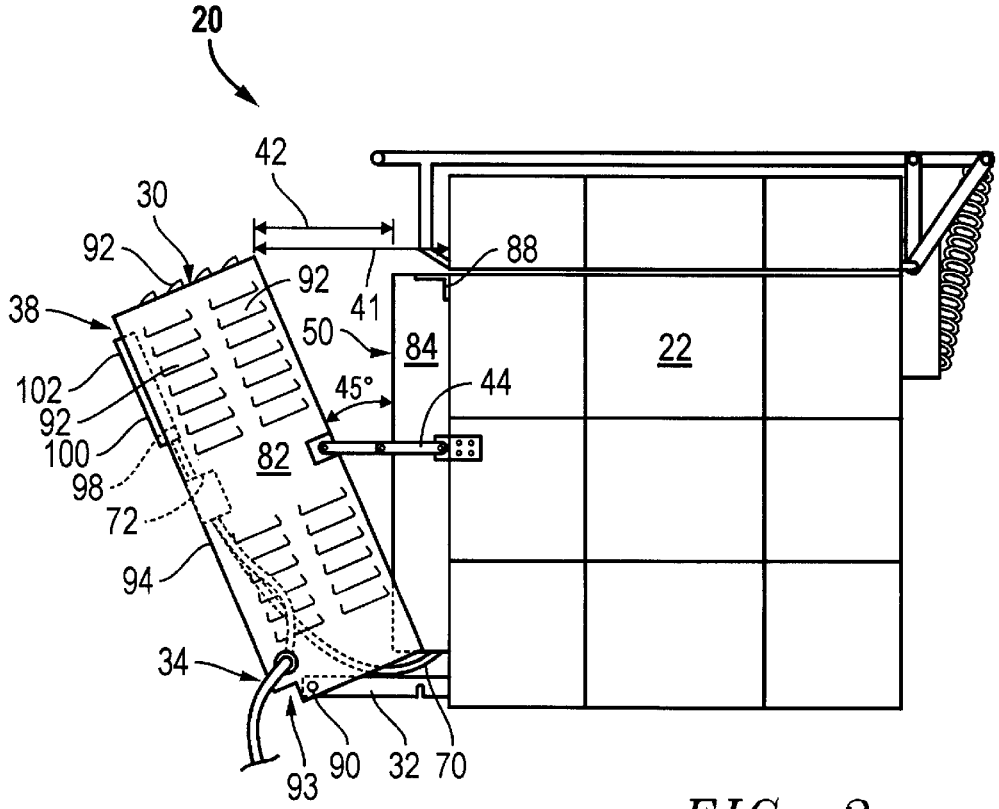
FIG. 3 is a side view of the kiln of FIGS. 1 and 2 with the control box in an open position.

As shown in FIG. 1 and FIG. 2, a control box 30 is pivotably coupled to the oven portion 22 by a hinge assembly 32. FIG. 2 is a side view of the kiln 20 in the upright operative position, and the control box 30 is shown in the closed, operative position. As shown in FIG. 3, the hinge assembly 32 has a cantilevered plate bracket projecting outwardly from the oven portion 22 to the front of the control box 30. The hinge assembly 32 also includes a pair of hinge stubs 90 that pivotably couple the plate bracket to the control box 30 so that the control box 30 can pivot about a horizontal axis 36 (FIG. 1). The hinge stubs support the control box at an offset position forward of the oven portion 11, thus providing clearance permitting the control box to rotate counter-clockwise to the drop-down maintenance position (FIG. 3).

A single shaft or axle may be used instead of the hinge stubs 90. The hinge assembly 32 is preferably fastened to the oven portion 22 with screws (not shown), but the hinge 32 may be attached to the oven portion 22 by other means (e.g., bolt, weld, strap, or tab and slot). In the first embodiment shown in FIGS. 1–3, the hinge assembly 32 is located at a lower housing portion 34 of the control box 30. However in other embodiments (not shown), the hinge assembly 32 may be located at a mid or upper portion of the control box 30.

The hinge 32 is configured so that the control box 30 can be pivoted about a hinge 32 from a closed position to an open position. Preferably, the control box 30 pivots about a generally horizontal axis 36 (e.g., horizontal, parallel to the bottom of the kiln, or slightly tilted relative to the bottom of the kiln). FIGS. 1 and 2 show the closed position with the upper end portion 38 control box 30 adjacent to the oven portion 22. FIG. 3 shows the open position with the upper housing portion 38 of the control box 30 separated from the oven portion 22 by a first spacing distance 41.

As shown in FIGS. 1 and 3, a scissors-type linkage 44 is preferably coupled between the control box 30 and the oven portion 22. In the closed position (see FIG. 1), the linkage 44 is folded. In the open position (see FIG. 3), the linkage 44 is fully extended to restrain the pivotal movement range of the control box 30 about the pivot axis 36. Preferably, the control box 30 forms an angle of about 45 degrees with respect to the oven portion 22 in the open position (see FIG. 3). However, the length and placement of the linkage 44 may be varied to provide different angles of inclination. For example, if the linkage 44 had longer linkage bars while being fastened to the control box 30 and oven portion 22 in the same locations, the angle between the control box 30 and the oven portion 22 would be increased at the fully open position.

A conventional kiln with a control box that can pivot freely about a vertical axis may be difficult to work on because it may swing from side-to-side while probing a component or while removing a component. One of the advantages of the present invention is that the position of the control box 30 is stabilized in the drop-down open position by the linkage 44. Also, with the control box 30 pivoting about a horizontal axis 36, gravity helps hold the control box 30 in the open position (see FIG. 3). Thus, when an operator is probing, testing, diagnosing or replacing components within the control box 30, the control box 30 remains stationary in the open position, without operator assistance.

Figure 4:
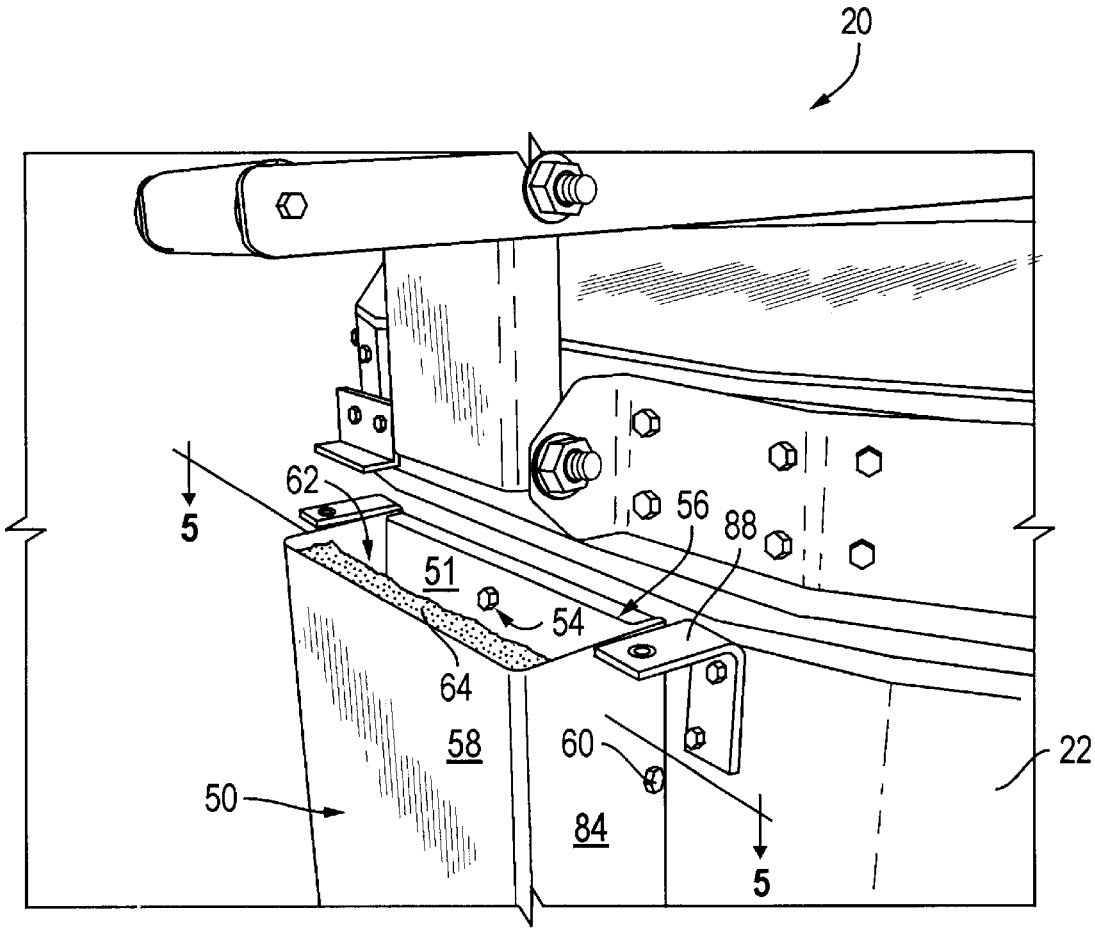
FIG. 4 is a perspective view of the kiln of FIG. 1 showing an upper end of a chimney portion when the control box is in an open position.
Figure 5:
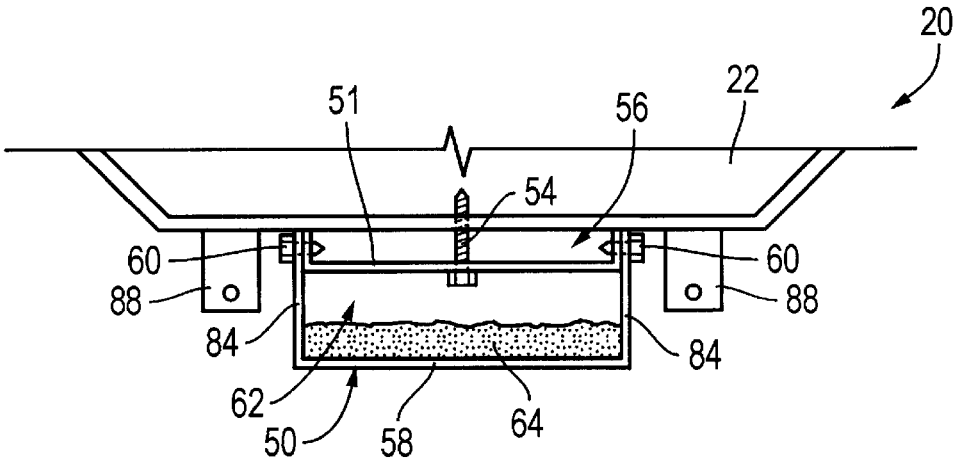
FIG. 5 is a sectional top view as taken along line 5—5 of FIG. 4.

A thermal insulation assembly 50 is attached to the outside of the oven portion 22. The assembly includes a chimney portion that is separate and spaced from the control box 30, and provides a thermal shield between the kiln and the electronic components in the control box. As shown in FIG. 3, the chimney portion 50 is exposed when the control box 30 is in an open (maintenance) position. When the control box 30 is in the open position, e.g., as in FIG. 3, the chimney portion 50 is separated from the upper end 38 of the control box 30 by a second spaced distance 42. FIG. 4 is a perspective view of the top of the chimney 50 when the control box 30 is in an open position. FIG. 5 is a sectional top view of the chimney 50 taken along line 5—5 in FIG. 4.

The chimney 50 has a first channel portion 51 formed from sheet metal, which is attached to the oven portion 22 by several machine screws 54. The number of screws 54 used to attach the chimney 50 to the oven portion 22 is preferably limited to minimized heat transfer paths from the oven portion 22 to the chimney 50. In the principal embodiment, the first channel portion 51 is attached by two screws 54, one screw at the upper end 38 (see FIG. 5) and another screw (not shown) at the lower end 34. A first air channel 56 is defined between the first channel portion 51 and the oven portion 22. This first air channel 56 provides thermal insulation and provides a heat convection tunnel for a flow of air through the first air channel 56.

A second channel portion 58 is also formed from sheet metal and is fastened to the first channel portion 51, as shown in FIG. 5. Preferably, the second channel portion 58 is attached to the first channel portion 51 by screws 60 (see FIGS. 5 and 6), but is not directly attached to the oven portion 22 with screws, to limit the amount of heat transfer from the oven portion 22 to the second channel portion 58. A second air channel 62 is defined between the first channel portion 51 and the second channel portion 58. Like the first air channel 56, the second air channel 62 also provides thermal insulation and provides another heat convection path for a flow of air through the chimney 50. As shown in FIG. 5, the second channel portion 58 has a layer of glass fiber insulating material 64 attached to it within the second air channel 62. The layer of glass fiber material 64 provides additional thermal insulation.

Figure 6:
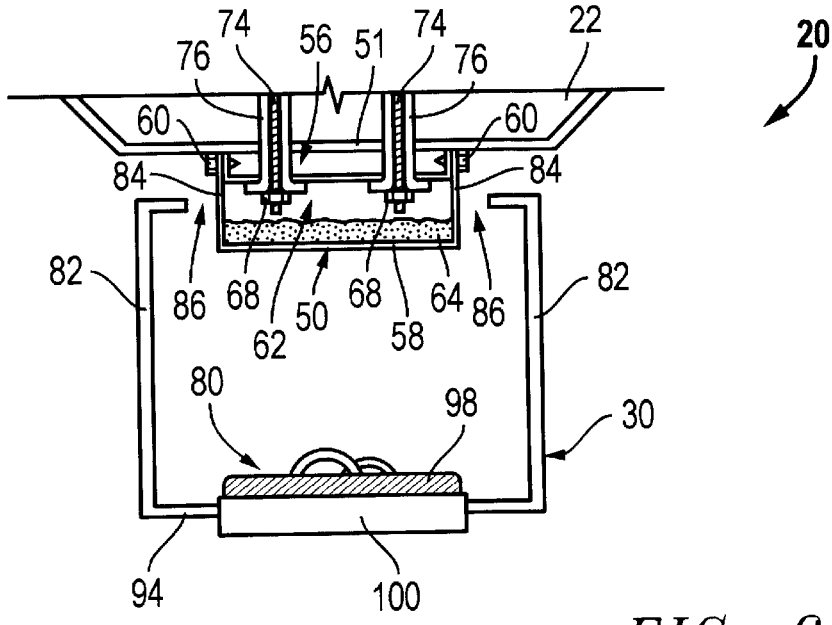
FIG. 6 is a sectional top view as taken along line 6—6 of FIG. 1.

FIG. 6 is a sectional top view taken along line 6—6 in FIG. 1. As shown in FIG. 6, the chimney portion 50 contains electrical connections 68 for electrical heating elements (not shown) within the oven portion 22. AC power conductors 70 connecting between the heating elements in the oven portion 22 and relays 72 in the control box are routed through the second air channel 62 of the chimney portion 50. In FIG. 3, the power conductors 70 extend from the bottom of the chimney portion 50 to the relays 72 in the control box 30. The chimney portion 50 is open on the bottom and top ends. Because hot air rises, heat from the oven portion 22 travels up and out of the chimney portion 50, which causes convection air flow through the chimney portion 50 (i.e., through the first and second air channels 56 and 62). Thus, convection air flow through the chimney portion helps to cool the wires 70 and limits temperature rise within the control box.

Note also in FIG. 6 that the heating element wires 74 are routing into the oven portion 22 from the chimney portion 50 via ceramic grommets 76. Because there is an opening to the oven portion 22 through the grommets 76 (around the wires 74), there is some heat flow through the grommets 76. Such heat flow is directed into the second air channel 62 in the chimney 50 and at least part of that heat flow is then routed out the top of the chimney 50. Thus, the chimney portion 50 provides numerous insulating and heat control functions.

The chimney portion 50 thermally insulates electronic controller components 80 in the control box 30 from the oven portion 22. In FIG. 6, the control box 30 is in the closed position. Note in FIG. 6 that the vertical sidewalls 82 of the control box 30 do not contact the vertical sidewalls 84 of the chimney portion 50 in the closed position and that there are side air channels 86 for allowing air to flow between the chimney portion 50 and the control box 30. These side air channels 86 provide further insulation and cooling benefits for the electronic controller components 80 within the control box 30.

Upper attachment brackets 88 are shown in FIGS. 4 and 5. The control box 30 is fastened to the upper attachment brackets 88 by machine screws when the control box 30 is in the closed position. However, a latch mechanism (not shown) also may be used to removably fasten the control box 30 to the attachment brackets 88. Hence, the control box 30 is attached to the oven portion 22 at the upper attachment brackets 88 by just two sheet metal screws and at the control box hinge 32 by just two hinge stubs 90. This limits the physical contact of the control box 30 with the oven portion 22, which in turn limits the amount of heat transferred to the control box 30 from the oven portion 22.

The control box 30 also has louvers 92 formed in many of its panels to provide additional air flow and cooling for control box 30. The louvers 92 on the side panels 82 of the control box 30 preferably open downward and louvers 92 on the top of the control box 30 preferably open toward the oven portion 22. There is also a slot 93 in the bottom of the control box 30 between the control box 30 and the hinge 32 to provide additional cooler air flow into the control box 30 (see FIGS. 2 and 7).

Figure 7:
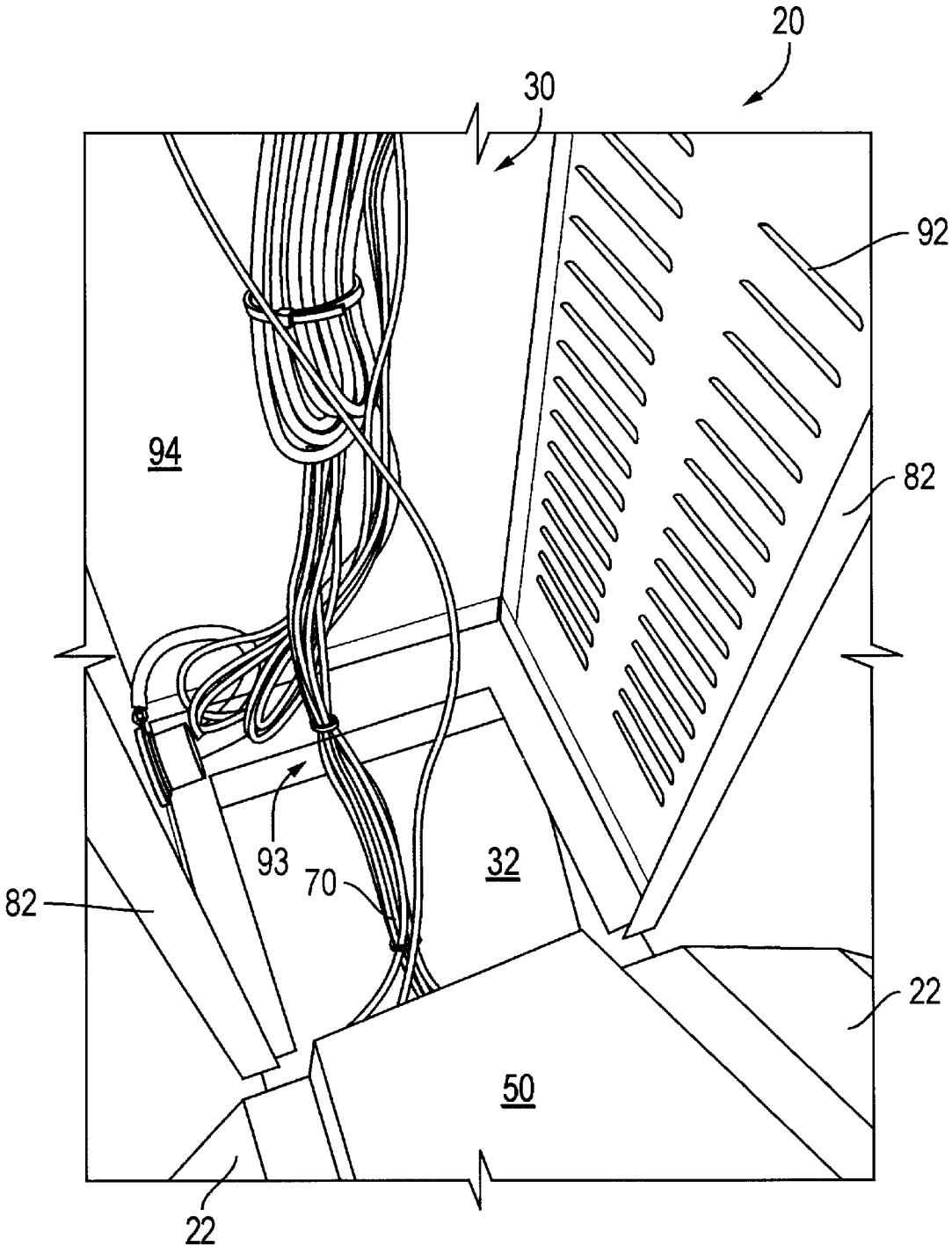
FIGS. 7 and 8 are top perspective views into the control box when the control box is in an open position.
Figure 8:
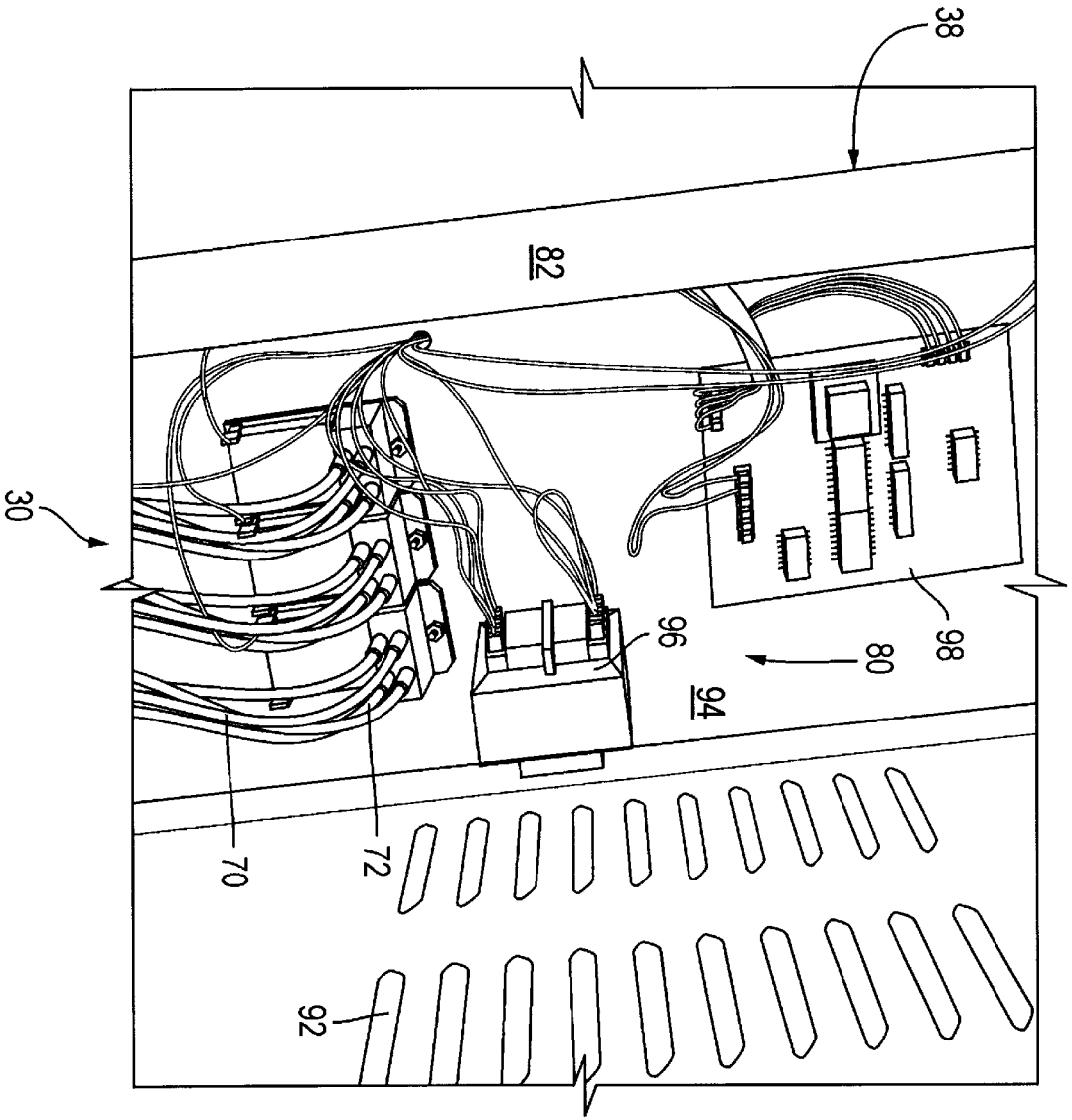

FIGS. 7 and 8 provide perspective views into the control box 30 when it is in the open position. As shown in FIG. 8, the electronic controller components 80 are mounted on the back side of and through the front panel 94 of the control box 30. The electrical components 80 are mounted on the front or side panel 94 so that they will be farther from the oven portion 22 and thus in a cooler location. In other embodiments, the electrical components 80 may also be mounted on the side panels of the control box 30. The electronic controller components 80 shown in FIG. 8 include power relays 72, a transformer 96, and a circuit board 98. As shown in FIG. 1, a keypad 100 and a digital display 102 are located on the front of the circuit board 98. Preferably, the keypad 100 and display 102 are located on an upper end 38 of the control box 30, which is advantageous for ease of use. However, the control box 30 is generally hotter at its upper end 38 than the lower end 34 because hot air rises. Hence, the higher temperature conditions at the upper end 38 of the control box 30 (as compared to the lower end 34 of the control box 30) must be taken into account in the design of the control box dimensions.

Generally, the control box 30 should be deeper (i.e., front panel 94 further from the oven portion 22) when the electronic control components 80 are placed higher in the control box 30. AC power conductors 70 leading from the relays 72 to the bottom of the chimney portion 50 (i.e., leading to the heating elements) can be seen in FIGS. 7 and 8.

As shown in FIGS. 7 and 8, another advantage of the preferred embodiment is that the electronic controller components 80 are exposed and accessible when the control box 30 is in the fully open position. Hence, electronic controller components 80, such as the relays 72, may be easily accessed for testing and being probed by simply removing the screws at the attachment brackets 88 and opening the control box 30. Thus, the relays 72 may be tested while the kiln is operational by moving the control box 30 to the fully open position, which is often desirable for troubleshooting. Also, one of the electronic controller components 80 may be replaced without removing the control box 30, which is yet another advantage.

The scissors linkage 44 may have a locking mechanism to allow the linkage 44 to be temporarily engaged and locked in a straightened configuration, which would oppose the movement of the control box 30 in both pivotal directions when locked. Although a simple scissors linkage 44 is shown in the first embodiment (see FIGS. 1 and 3), other types of linkages may be used to provide the same result (i.e., limiting the pivotal range of movement for the control box 30 in an open position). For example, a slider linkage with a stop may be used instead of the scissors linkage 44.

Figure 9A:
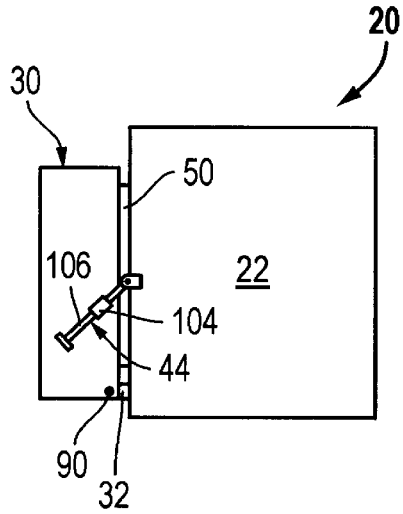
FIGS. 9A and 9B are side views of a kiln with a drop-down control box coupled by a scissors linkage.
Figure 9B:
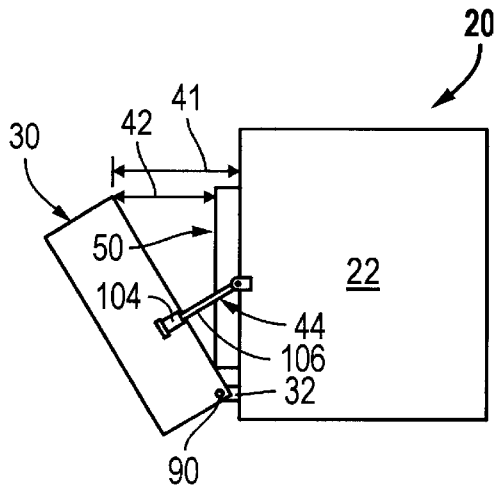

FIGS. 9A and 9B show side views of a kiln 20 in which the hinge pivot axis 36 is closer to the oven portion 22 than in the principal embodiment (compare to FIG. 3). Hence, the location of the hinge pivot axis 36 may vary. A slider may be used with the linkage 44 to limit the pivot movement range of the control box 30 in the fully open position. A slider block 104 attached to the control box 30 is allowed to pivot as the rod portion 106 slides within it at different angles.

Figure 10A:
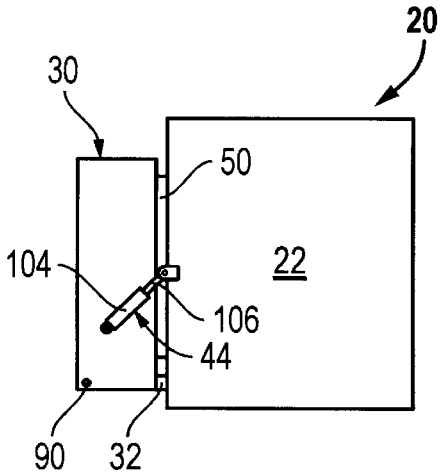
FIGS. 10A and 10B are side views of a kiln with a drop-down control box coupled by a hydraulic actuator.
Figure 10B:
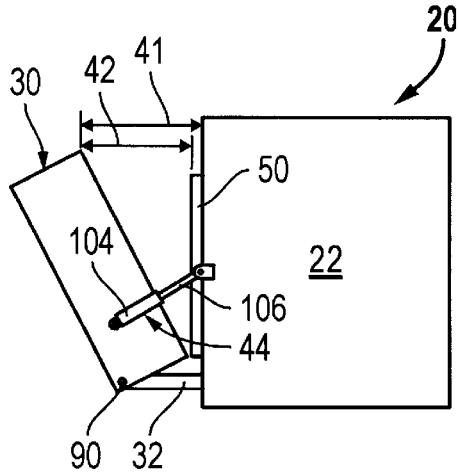
Figure 11A:
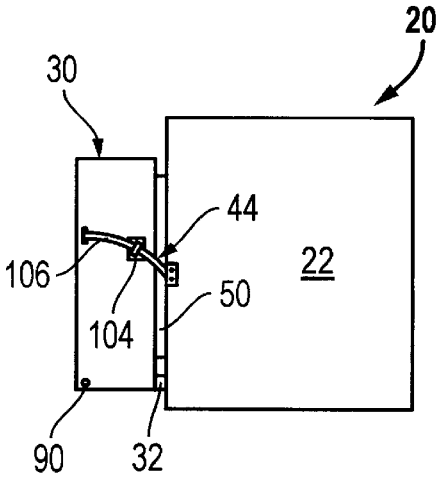
FIGS. 11A and 11B are side views of a kiln with a drop-down control box coupled by a slider.
Figure 11B:
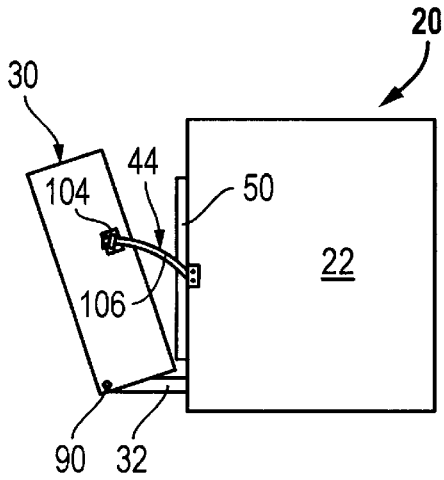

FIGS. 10A and 10B show side views of a kiln 20 in which a motion dampener mechanism is used for the linkage 44, and in this arrangement, the linking mechanism is a hydraulic motion dampener. Pneumatic and spring-loaded motion dampeners can be substituted, if desired. FIGS. 11A and 11B show side views of a kiln 20 in which the slider mechanism used for the linkage 44 has an arc-shaped rod 106 and a fixed slider slot 104. The arc of the rod 106 matches the radial distance from the hinge pivot axis 36.

Figure 12A:
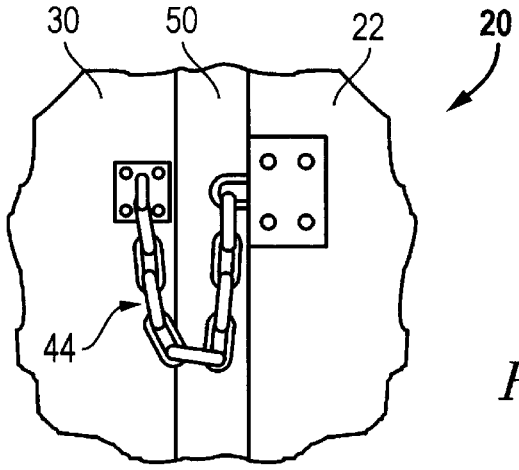
FIGS. 12A and 12B are partial side views of a kiln with a drop-down control box coupled by a chain.
Figure 12B:
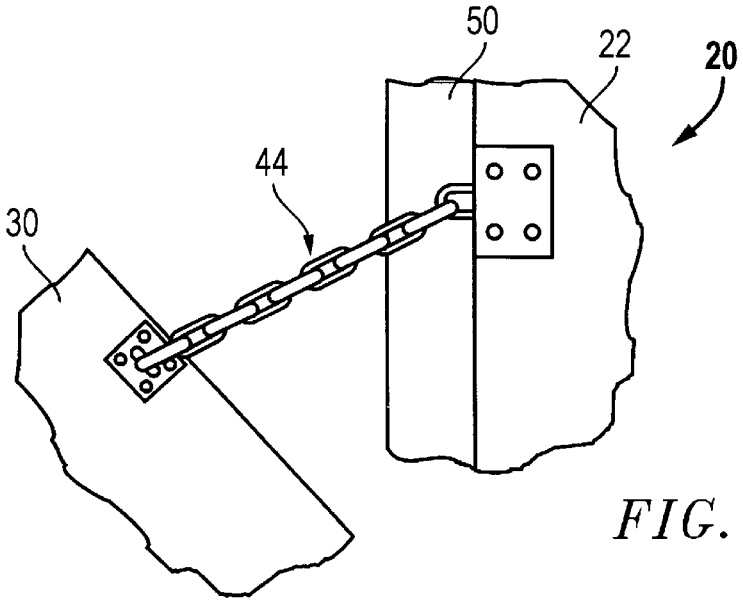
Figure 13A:
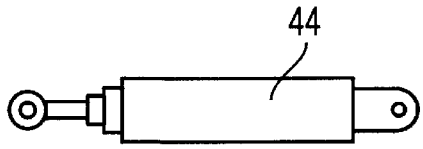
FIGS. 13A and 13B show a telescopic linkage for coupling the drop-down control box to the kiln.
Figure 13B:
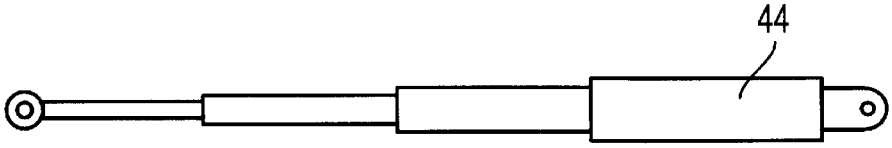

FIGS. 12A and 12B show partial side views of a kiln 20 in which a chain is used for the linkage 44 to limit the pivotal movement range of the cover box 30 at the fully open position. Alternatively, a rope, core, wire or cable may be substituted for the chain. FIGS. 13A and 13B show a telescoping linkage 44 that may also be used to limit the pivotal movement range of the control box relative to the oven portion.

Although the preferred embodiments shown herein have horizontal pivot axis 36 (as preferred), the pivot axis 36 may be configured at other angles (e.g., slightly tilted from horizontal, vertical or sloped).

Although the invention has been described with reference to certain exemplary arrangements, it is to be understood that the form of the invention shown and described is to be treated as a preferred embodiment. In light of the description herein, various changes, substitutions, and modifications may be realized without departing from the spirit and scope of the invention defined by the following claims.

We claim:

1. A kiln, comprising:

an oven portion including an oven sidewall;

a control box including sidewalls forming a protective housing and electronic controller components contained at least partially within the protective housing, the protective housing including an access opening through which maintenance actions can be performed on the electronic controller components;

the control box being coupled to the oven portion for movement to a closed position in which the access opening is disposed in close proximity to the oven sidewall and maintenance access through the access opening is at least partially blocked by the oven sidewall, and to a maintenance position in which the access opening is spaced from the oven sidewall by a spacing distance that is sufficient to allow maintenance actions to be performed through the access opening; and a thermal insulation assembly attached to and spaced from the oven portion, the thermal insulation assembly providing a thermal shield between the oven sidewall and the electronic controller components when the control box is in the closed position.

2. The kiln of claim 1, the thermal insulation assembly including sidewall portions defining a convection air flow chimney passage between the oven sidewall and the control box.

3. The kiln of claim 1, wherein the thermal insulation assembly comprises:

a first sheet metal channel attached to the oven portion;

a second sheet metal channel attached to the first sheet metal channel; and a layer of insulating material attached to the second sheet metal channel.

4. The kiln of claim 1, wherein the protective housing of the control box includes side portions that are spaced from the thermal insulation assembly and air channels are defined between the side portions of the control box and the thermal insulation assembly when the control box is in the closed position.

5. The kiln of claim 1, wherein a keypad and a control display unit of the electronic controller components are mounted on an external portion of the control box providing operator access proximate the top of the kiln when the control box is in the closed position.

6. The kiln of claim 1, including a hinge assembly connecting the control box to the oven portion.

7. The kiln of claim 1, further comprising a linkage coupled between the control box and the oven portion for limiting movement range of the control box relative to the oven portion.

8. A kiln, comprising:

an oven portion including an oven sidewall;

a control box including sidewalls forming a protective housing and electronic controller components contained at least partially within the protective housing, the control box being releasably secured in latched engagement with the oven portion in a closed position in which the control box is disposed in close proximity to the oven sidewall and access to the electronic controller components is restricted, and releasable from latched engagement to permit movement of the protective housing away from the oven sidewall to a maintenance position in which the access opening is spaced from the oven sidewall by a spacing distance that is sufficient to allow maintenance actions to be performed through the access opening; and a hinge assembly connecting the control box to the oven portion, the hinge assembly supporting drop-down pivotal movement of the control box from the closed position to the maintenance position.

9. The kiln of claim 8, the hinge assembly including a cantilevered support bracket attached to the oven portion and projecting outwardly therefrom, and a pair of hinge stubs coupled between the control box and the support bracket defining pivot bearing surfaces supporting pivotal movement of the control box.

10. The kiln of claim 8, further comprising a linkage coupled between the control box and the oven portion for limiting drop-down movement range of the control box relative to the oven portion.

11. A kiln, comprising:

an oven portion having walls defining an oven space;

a control box including sidewalls forming a protective housing and electronic controller components contained at least partially within the protective housing, the protective housing including first and second end portions and an access opening disposed between the first and second end portions through which maintenance actions can be performed on the electronic controller components; and a hinge assembly connecting the first end portion of the protective housing to the oven portion, the hinge assembly supporting pivotal movement of the control box to a closed position in which the second end portion of the control box is disposed closely adjacent the oven portion, and to a drop-down maintenance position in which the second end portion of the protective housing is angularly displaced and separated from the oven portion and the sidewalls of the control box slope transversely relative to the kiln sidewall; and a linkage coupled to the control box and the oven portion for limiting drop-down movement range of the control box relative to the oven portion.

12. The kiln of claim 11, wherein the linkage comprises a scissors coupling assembly.

13. The kiln of claim 11, wherein the linkage comprises a slider and stop coupling assembly.

14. The kiln of claim 11, wherein the linkage comprises a motion dampener assembly.

15. The kiln of claim 11, wherein the linkage comprises a chain.

16. The kiln of claim 11, wherein the linkage comprises telescoping sections.

17. The kiln of claim 11, wherein the control box slopes transversely relative to the oven portion by an angle of approximately 45° when the control box is in the maintenance position.

18. The kiln of claim 11, further comprising a thermally insulating chimney portion attached to the oven portion, wherein the chimney portion is disposed between the oven portion and the electronic controller components when the control box is in the closed position, and wherein the chimney portion is separated from the second end portion of the control box when the control box is in the maintenance position.

19. The kiln of claim 18, wherein the control box includes side portions that are separated from the chimney portion when the control box is in the closed position and wherein air channels are defined between the side portions of the control box and the chimney portion.

20. A kiln, comprising:

an oven portion having walls defining an oven space;

a control box including sidewalls forming a protective housing and electronic controller components contained at least partially within the protective housing, the protective housing including first and second end portions and an access opening disposed between the first and second end portions through which maintenance actions can be performed on the electronic controller components;

a thermal insulation assembly attached to and spaced from the oven portion, the thermal insulation assembly providing a thermal shield between the oven sidewall and the electronic controller components when the control box is in the closed position;

a hinge assembly connecting the first end portion of the protective housing to the oven portion, the hinge assembly supporting pivotal movement of the control box to a closed position in which the second end portion of the control box is disposed closely adjacent the oven portion, and to a drop-down maintenance position in which the second end portion of the protective housing is angularly displaced and separated from the oven portion; and means coupled to the control box and the oven portion for limiting drop-down movement range of the control box relative to the oven portion.

* * * * *